US009333546B2

(12) United States Patent
Abe

(10) Patent No.: US 9,333,546 B2
(45) Date of Patent: May 10, 2016

(54) ROLLER LEVELER AND METAL SHEET FLATTENING METHOD

(75) Inventor: Keizo Abe, Yokohama (JP)

(73) Assignee: JP STEEL PLANTECH CO., Yokohama-shi (JP)

( * ) Notice: Subject to any disclaimer, the term of this patent is extended or adjusted under 35 U.S.C. 154(b) by 221 days.

(21) Appl. No.: 14/001,407

(22) PCT Filed: Feb. 3, 2012

(86) PCT No.: PCT/JP2012/052533

§ 371 (c)(1),
(2), (4) Date: Aug. 23, 2013

(87) PCT Pub. No.: WO2012/114853

PCT Pub. Date: Aug. 30, 2012

(65) Prior Publication Data

US 2013/0327109 A1 Dec. 12, 2013

(30) Foreign Application Priority Data

Feb. 24, 2011 (JP) ..... 2011-038047

(51) Int. Cl.
*B21D 1/05* (2006.01)
*B21B 31/20* (2006.01)
(Continued)

(52) U.S. Cl.
CPC ... *B21D 1/05* (2013.01); *B21B 1/30* (2013.01); *B21B 31/20* (2013.01); *B21B 37/38* (2013.01);
(Continued)

(58) Field of Classification Search
CPC ..... B21D 1/02; B21D 1/05; B21B 1/22–1/36; B21B 1/38; B21B 1/40; B21B 37/20; B21B 31/32; B21B 37/38; B21B 13/14; B21B 39/20; B21B 41/02; B21B 41/04; B21B 41/06; B21B 41/08; B21B 2015/0071; B21B 2001/386; B21B 2273/06; B21B 2273/08; B21B 2273/12; B21B 2273/14; B21B 2273/16
USPC ..... 72/160, 161, 165, 226, 227, 229, 231, 72/365.2, 379.2
See application file for complete search history.

(56) References Cited

U.S. PATENT DOCUMENTS 4,651,549 A 3/1987 Masui
5,622,072 A * 4/1997 Benz ..... 72/163
(Continued)

FOREIGN PATENT DOCUMENTS

CN 1693000 A 11/2005
CN 202921693 U 5/2013
(Continued)

OTHER PUBLICATIONS

JP 11-123457 Machine Translation from Japan Platform for Patent Information (J-PlatPat).*
(Continued)

*Primary Examiner* — Peter Dungba Vo
*Assistant Examiner* — Joshua D Anderson
(74) *Attorney, Agent, or Firm* — Oblon, McClelland, Maier & Neustadt, L.L.P.

(57) ABSTRACT

A roller leveler for flattening a metal sheet or plate having a cut-sheet form includes leveling rolls disposed in a staggered state on upper and lower sides of a pass line and configured to sandwich and flatten the metal sheet while pressing it therethrough, a hydraulic pressing cylinder configured to press the metal sheet via the leveling rolls, a drive unit configured to rotate the leveling rolls, and a pinch roll unit disposed on one side of a leveling roll array area and including a pair of pinch rolls. The pressing cylinder presses the metal sheet via the leveling rolls with a pressing amount necessary for flattening the metal sheet, while the metal sheet is passed by a drawing force applied by the pinch rolls and a driving force applied by the drive unit.

7 Claims, 8 Drawing Sheets

(51) Int. Cl.

| | |
|---|---|
| ***B21B 37/38*** | (2006.01) |
| ***B21B 1/30*** | (2006.01) |
| ***B21D 1/02*** | (2006.01) |
| *B21B 41/02* | (2006.01) |
| *B21B 41/06* | (2006.01) |
| *B21B 13/14* | (2006.01) |
| *B21B 15/00* | (2006.01) |

(52) U.S. Cl.
CPC . *B21D 1/02* (2013.01); *B21B 13/14* (2013.01); *B21B 41/02* (2013.01); *B21B 41/06* (2013.01); *B21B 2015/0071* (2013.01); *B21B 2273/06* (2013.01)

(56) References Cited

U.S. PATENT DOCUMENTS

| | | | | |
|---|---|---|---|---|
| 5,636,543 | A * | 6/1997 | Kajiwara et al. | 72/234 |
| 6,009,736 | A * | 1/2000 | Ginzburg | 72/148 |
| 6,014,882 | A * | 1/2000 | Berger et al. | 72/229 |
| 7,530,250 | B2 * | 5/2009 | Hartung et al. | 72/160 |
| 2009/0113973 | A1 | 5/2009 | Cox, III | |
| 2009/0282883 | A1 * | 11/2009 | Noe | 72/160 |

FOREIGN PATENT DOCUMENTS

| | | |
|---|---|---|
| JP | 58 168435 | 10/1983 |
| JP | 3 204118 | 9/1991 |
| JP | 5-57350 | 3/1993 |
| JP | 2000-326012 | 11/2000 |
| JP | 3443036 | 9/2003 |
| JP | 2005 152964 | 6/2005 |
| JP | 3726146 | 12/2005 |
| JP | 2008-100260 | 5/2008 |
| JP | 2009 255148 | 11/2009 |

OTHER PUBLICATIONS

JP 2000-326012 Translated Abstract from EAST.*

Korean Office Action issued Aug. 5, 2014, in Korea Patent Application No. 10-2013-7023457 (with English Translation).

U.S. Appl. No. 14/378,041, filed Aug. 11, 2014, Abe.

Office Action issued in corresponding Chinese Patent Application No. 201210042165.6 dated Dec. 4, 2013 (with English translation).

International Search Report Issued Apr. 24, 2012 in PCT/JP12/52533 Filed Feb. 3, 2012.

* cited by examiner

ROLLER LEVELER AND METAL SHEET FLATTENING METHOD

TECHNICAL FIELD

The present invention relates to a roller leveler for flattening a metal sheet or plate having a cut-sheet form and a metal sheet flattening method.

BACKGROUND ART

In the process of manufacturing a metal sheet, such as a steel sheet, the metal sheet is subjected to rolling and cooling steps, in which the metal sheet undergoes deformation, such as warping and/or waving. Accordingly, in order to remedy the deformation, such as warping and/or waving, and thereby to flatten the metal sheet, a roller leveler, which includes a plurality of leveling rolls disposed on upper and lower sides in a staggered state, is used (for example, Patent Document 1).

The roller leveler is configured to pass a metal sheet to be flattened between the lower rolls and the upper rolls, while pushing the upper rolls toward the lower rolls or pushing the lower rolls toward the upper rolls, to repeatedly apply bending to the metal sheet, and thereby to planarize the warping and/or waving of the metal sheet. At this time, the pressing amount of the respective rolls of the roller leveler is suitably set to bend the metal sheet at a yield ratio preferably of 0.7 or more.

PRIOR ART DOCUMENT

Patent Document

[Patent Document 1]
Jpn. Pat. Appln. KOKAI Publication No. 2009-255148

SUMMARY OF INVENTION

When a conventional roller leveler is used to flatten a metal sheet having a cut-sheet form, the driving force for passing the metal sheet depends on the torque of the leveling rolls. In order to flatten a thin metal sheet made of a material with a larger yield stress, the diameter of the rolls needs to be small. This brings about a problem such that, if it is arranged to ensure the pressing amount necessary for the flattening, the torque of the work rolls becomes insufficient to pass the metal sheet.

This is because, in order to apply a sufficient pressing amount, drive shafts connected to drive the leveling rolls need to have a diameter smaller than that of the rolls. For this reason, when the leveling rolls have a small diameter to flatten a thin metal sheet, which is made of a material with a larger yield stress, their torque inevitably becomes small. In this case, the torque may be smaller than the value necessary for passing the metal sheet if it is arranged to ensure the yield ratio necessary for flattening the metal sheet.

In light of this problem, conventionally, when flattening is performed on a metal sheet having a small thickness and a large yield stress, it is necessary to restrictively set the pressing amount of the leveling rolls to a value that enables the sheet passing even by the torque of the leveling rolls. Consequently, there may be a case where the metal sheet is not sufficiently flattened.

The present invention has been made under the circumstances, and an object of the present invention is to provide a roller leveler and a metal sheet flattening method, which can sufficiently flatten a metal sheet having a small thickness and a large yield stress.

In order to solve the problem mentioned above, the present invention includes the following aspects.

According to a first aspect of the present invention, there is provided a roller leveler for flattening a metal sheet having a cut-sheet form, the roller leveler including: a plurality of leveling rolls disposed in a staggered state on upper and lower sides of a pass line of the metal sheet to be flattened and configured to rotate to sandwich and flatten the metal sheet while passing the metal sheet therethrough; a hydraulic pressing cylinder configured to press the metal sheet via the leveling rolls; a drive unit configured to rotate the leveling rolls to pass the metal sheet; and a pinch roll unit disposed on one side of a leveling roll array area, in which the leveling rolls are disposed along the pass line of the metal sheet, and having a pair of pinch rolls configured to pinch the metal sheet and apply a drawing force thereto, wherein the roller leveler is configured to cause the pressing cylinder to press the metal sheet via the leveling rolls with a pressing amount necessary for flattening the metal sheet while passing the metal sheet between the leveling rolls by a driving force applied by the drive unit and the drawing force applied by the pinch rolls.

According to a second aspect of the present invention, there is provided a roller leveler for flattening a metal sheet having a cut-sheet form, the roller leveler including: a leveling unit that has a plurality of leveling rolls disposed in a staggered state on upper and lower sides of a pass line of the metal sheet to be flattened and configured to rotate to sandwich and flatten the metal sheet while passing the metal sheet therethrough, a hydraulic pressing cylinder configured to press the metal sheet via the leveling rolls, and a drive unit configured to rotate the leveling rolls to pass the metal sheet; a first pinch roll unit and a second pinch roll unit respectively disposed on opposite outsides of a leveling roll array area, in which the leveling rolls are disposed along the pass line of the metal sheet, each of the first and second pinch roll units having a pair of pinch rolls configured to pinch the metal sheet and apply a drawing force thereto; and a control system configured to control flattening of the metal sheet, wherein the control system is configured to perform control such that the metal sheet is passed through the leveling roll array area in a first direction oriented from the first pinch roll unit toward the second pinch roll unit, in a state where the metal sheet is not pressed or in a state where the metal sheet is pressed by the pressing cylinder with a pressing amount small enough to allow the metal sheet to be passed by the drive unit; then, when a leading end of the metal sheet reaches the second pinch roll unit, the pressing amount given by the pressing cylinder is increased to a value necessary for flattening the metal sheet, and a drawing force in the first direction is applied by the second pinch roll unit to the metal sheet to pass the metal sheet; then, when a tail end of the metal sheet has passed through the leveling roll array area, a feed direction of the metal sheet is changed from the first direction to a second direction opposite to the first direction; then the metal sheet is passed through the leveling roll array area in the second direction, in a state where the metal sheet is not pressed or in a state where the metal sheet is pressed by the pressing cylinder with a pressing amount small enough to allow the metal sheet to be passed by the drive unit; and then, when the tail end of the metal sheet reaches the first pinch roll unit, the pressing amount given by the pressing cylinder is increased to a value necessary for flattening the metal sheet, and a drawing force in the second direction is applied by the first pinch roll unit to the metal sheet to pass the metal sheet.

According to a third aspect of the present invention, there is provided a roller leveler for flattening a metal sheet having a cut-sheet form, the roller leveler including: a leveling unit that has a plurality of leveling rolls disposed in a staggered state on upper and lower sides of a pass line of the metal sheet to be flattened and configured to rotate to sandwich and flatten the metal sheet while passing the metal sheet therethrough, a hydraulic pressing cylinder configured to press the metal sheet via the leveling rolls, and a drive unit configured to rotate the leveling rolls to pass the metal sheet; a pinch roll unit disposed on one outside of a leveling roll array area, in which the leveling rolls are disposed along the pass line of the metal sheet, and having a pair of pinch rolls configured to pinch the metal sheet and apply a drawing force thereto; a metal sheet reversing mechanism disposed on the other outside of the leveling roll array area, and configured to turn the metal sheet to reverse positions of leading and tail ends thereof; and a control system configured to control flattening of the metal sheet, wherein the control system is configured to perform control such that the metal sheet is passed through the leveling roll array area from a metal sheet reversing mechanism-side of the leveling unit, in a state where the metal sheet is not pressed or in a state where the metal sheet is pressed by the pressing cylinder with a pressing amount small enough to allow the metal sheet to be passed by the drive unit; then, when a leading end of the metal sheet reaches the pinch roll unit, the pressing amount given by the pressing cylinder is increased to a value necessary for flattening the metal sheet, and a drawing force is applied by the pinch roll unit to the metal sheet to pass the metal sheet; then, when a tail end of the metal sheet has passed through the leveling roll array area, the metal sheet is transferred into the metal sheet reversing mechanism and the metal sheet is turned to reverse positions of the leading end and the tail end thereof; then, the metal sheet thus reversed is passed through the leveling roll array area from the metal sheet reversing mechanism-side, in a state where the metal sheet is not pressed or in a state where the metal sheet is pressed by the pressing cylinder with a pressing amount small enough to allow the metal sheet to be passed by the drive unit; and then, when the leading end of the metal sheet reaches the pinch roll unit, the pressing amount given by the pressing cylinder is increased to a value necessary for flattening the metal sheet, and a drawing force is applied by the pinch roll unit to the metal sheet to pass the metal sheet.

According to a fourth aspect of the present invention, there is provided a roller leveler for flattening a metal sheet having a cut-sheet form, the roller leveler including: first and second leveling units arrayed along a pass direction of the metal sheet, and each having a plurality of leveling rolls disposed in a staggered state on upper and lower sides of a pass line of the metal sheet to be flattened and configured to rotate to sandwich and flatten the metal sheet while passing the metal sheet therethrough, a hydraulic pressing cylinder configured to press the metal sheet via the leveling rolls, and a drive unit configured to rotate the leveling rolls to pass the metal sheet; a pinch roll unit disposed between the first leveling unit and the second leveling unit, and having a pair of pinch rolls configured to pinch the metal sheet and apply a drawing force thereto; and a control system configured to control flattening of the metal sheet, wherein the control system is configured to perform control such that the second leveling unit is set in a state where the metal sheet is to be not pressed or in a state where the metal sheet is to be pressed by the pressing cylinder with a pressing amount small enough to allow the metal sheet to be passed by the drive unit; then the metal sheet is passed, toward the second leveling unit, through a first leveling roll array area of the first leveling unit, in which the leveling rolls are disposed, in a state where the metal sheet is not pressed or in a state where the metal sheet is pressed by the pressing cylinder with a pressing amount small enough to allow the metal sheet to be passed by the drive unit; then, when a leading end of the metal sheet reaches the pinch roll unit, the pressing amount given by the pressing cylinder of the first leveling unit is increased to a value necessary for flattening the metal sheet, and a drawing force is applied by the pinch roll unit to the metal sheet to pass the metal sheet; then, when a tail end of the metal sheet reaches the pinch roll unit, the first leveling unit is set in a state where the metal sheet is to be not pressed or in a state where the metal sheet is to be pressed by the pressing cylinder with a pressing amount small enough to allow the metal sheet to be passed by the drive unit; and then the pressing amount given by the pressing cylinder of the second leveling unit is increased to a value necessary for flattening the metal sheet, and a drawing force is applied by the pinch roll unit to the metal sheet to pass the metal sheet toward the first leveling unit.

According to a fifth aspect of the present invention, there is provided a roller leveler including: a plurality of leveling rolls disposed in a staggered state on upper and lower sides of a pass line of a metal sheet to be flattened and configured to rotate to sandwich and flatten the metal sheet while passing the metal sheet therethrough; a plurality of backup rolls that back up the plurality of leveling rolls on the upper and lower sides; a pair of roll frames that support the leveling rolls and the backup rolls on the upper and lower sides, respectively; a pair of frames that support the pair of roll frames on the upper and lower sides, respectively; a hydraulic pressing cylinder configured to press one of the pair of frames to press the metal sheet via one of the roll frames and the leveling rolls; a drive unit configured to rotate the leveling rolls; a plurality of hydraulic crowning cylinders arrayed along a width direction perpendicular to a pass direction of the metal sheet between one of the frames configured to be pressed by the pressing cylinder and a corresponding one of the roll frames; a pinch roll unit disposed on one side of a leveling roll array area, in which the leveling rolls are disposed along the pass line of the metal sheet, and having a pair of pinch rolls configured to pinch the metal sheet and apply a drawing force thereto; and a control system configured to control flattening of the metal sheet, wherein the control system is configured to perform control such that the pressing cylinder presses the metal sheet via the leveling rolls with a pressing amount necessary for flattening the metal sheet while the metal sheet is passed between the leveling rolls by a driving force applied by the drive unit and the drawing force applied by the pinch rolls, and wherein the control system is configured to obtain lateral deflection amounts of the pair of frames, to calculate necessary tightening amounts of the respective hydraulic crowning cylinders necessary for compensating for the deflection amounts, and to control tightening of the respective hydraulic crowning cylinders based on the necessary tightening amounts.

In the fifth aspect, it is preferable that the control system be configured to calculate necessary tightening amounts of the respective hydraulic crowning cylinders necessary for compensating for compressive deformation of the pressing cylinder, the hydraulic crowning cylinders, the pair of roll frames, the backup rolls, and the leveling rolls based on information on the compressive deformation, and to control tightening of the respective hydraulic crowning cylinders based on a total value of the necessary tightening amounts necessary for compensating for the compressive deformation and the necessary tightening amounts necessary for compensating for the deflection amounts of the pair of frames.

According to a sixth aspect of the present invention, there is provided a metal sheet flattening method of flattening a metal sheet having a cut-sheet form in a roller leveler, which includes a plurality of leveling rolls disposed in a staggered state on upper and lower sides of a pass line of the metal sheet to be flattened and configured to rotate to sandwich and flatten the metal sheet while passing the metal sheet therethrough, a hydraulic pressing cylinder configured to press the metal sheet via the leveling rolls, a drive unit configured to rotate the leveling rolls to pass the metal sheet, and a pinch roll unit disposed on one side of a leveling roll array area, in which the leveling rolls are disposed along the pass line of the metal sheet, and having a pair of pinch rolls configured to pinch the metal sheet and apply a drawing force thereto, the method including: causing the pressing cylinder to press the metal sheet via the leveling rolls with a pressing amount necessary for flattening the metal sheet, while passing the metal sheet between the leveling rolls by a driving force applied by the drive unit and the drawing force applied by the pinch rolls.

According to a seventh aspect of the present invention, there is provided a metal sheet flattening method of flattening a metal sheet having a cut-sheet form in a roller leveler, which includes a leveling unit that has a plurality of leveling rolls disposed in a staggered state on upper and lower sides of a pass line of the metal sheet to be flattened and configured to rotate to sandwich and flatten the metal sheet while passing the metal sheet therethrough, a hydraulic pressing cylinder configured to press the metal sheet via the leveling rolls, and a drive unit configured to rotate the leveling rolls to pass the metal sheet, and a first pinch roll unit and a second pinch roll unit respectively disposed on opposite outsides of a leveling roll array area, in which the leveling rolls are disposed along the pass line of the metal sheet, each of the first and second pinch roll units having a pair of pinch rolls configured to pinch the metal sheet and apply a drawing force thereto, the method including: passing the metal sheet through the leveling roll array area in a first direction oriented from the first pinch roll unit toward the second pinch roll unit, in a state where the metal sheet is not pressed or in a state where the metal sheet is pressed by the pressing cylinder with a pressing amount small enough to allow the metal sheet to be passed by the drive unit; then, when a leading end of the metal sheet reaches the second pinch roll unit, increasing the pressing amount given by the pressing cylinder to a value necessary for flattening the metal sheet, and applying a drawing force in the first direction by the second pinch roll unit to the metal sheet to pass the metal sheet; then, when a tail end of the metal sheet has passed through the leveling roll array area, changing a feed direction of the metal sheet from the first direction to a second direction opposite to the first direction; then passing the metal sheet through the leveling roll array area in the second direction, in a state where the metal sheet is not pressed or in a state where the metal sheet is pressed by the pressing cylinder with a pressing amount small enough to allow the metal sheet to be passed by the drive unit; and then, when the tail end of the metal sheet reaches the first pinch roll unit, increasing the pressing amount given by the pressing cylinder to a value necessary for flattening the metal sheet, and applying a drawing force in the second direction by the first pinch roll unit to the metal sheet to pass the metal sheet.

According to an eighth aspect of the present invention, there is provided a metal sheet flattening method of flattening a metal sheet having a cut-sheet form in a roller leveler, which includes a leveling unit that has a plurality of leveling rolls disposed in a staggered state on upper and lower sides of a pass line of the metal sheet to be flattened and configured to rotate to sandwich and flatten the metal sheet while passing the metal sheet therethrough, a hydraulic pressing cylinder configured to press the metal sheet via the leveling rolls, and a drive unit configured to rotate the leveling rolls to pass the metal sheet, a pinch roll unit disposed on one outside of a leveling roll array area, in which the leveling rolls are disposed along the pass line of the metal sheet, and having a pair of pinch rolls configured to pinch the metal sheet and apply a drawing force thereto, and a metal sheet reversing mechanism disposed on the other outside of the leveling roll array area, and configured to turn the metal sheet to reverse positions of leading and tail ends thereof, the method including: passing the metal sheet through the leveling roll array area from a metal sheet reversing mechanism-side of the leveling unit, in a state where the metal sheet is not pressed or in a state where the metal sheet is pressed by the pressing cylinder with a pressing amount small enough to allow the metal sheet to be passed by the drive unit; then, when a leading end of the metal sheet reaches the pinch roll unit, increasing the pressing amount given by the pressing cylinder to a value necessary for flattening the metal sheet, and applying a drawing force by the pinch roll unit to the metal sheet to pass the metal sheet; then, when a tail end of the metal sheet has passed through the leveling roll array area, transferring the metal sheet into the metal sheet reversing mechanism and turning the metal sheet to reverse positions of the leading end and the tail end thereof; then, passing the metal sheet thus reversed through the leveling roll array area from the metal sheet reversing mechanism-side, in a state where the metal sheet is not pressed or in a state where the metal sheet is pressed by the pressing cylinder with a pressing amount small enough to allow the metal sheet to be passed by the drive unit; and then, when the leading end of the metal sheet reaches the pinch roll unit, increasing the pressing amount given by the pressing cylinder to a value necessary for flattening the metal sheet, and applying a drawing force by the pinch roll unit to the metal sheet to pass the metal sheet.

According to a ninth aspect of the present invention, there is provided a metal sheet flattening method of flattening a metal sheet having a cut-sheet form in a roller leveler, which includes first and second leveling units arrayed along a pass direction of the metal sheet, and each having a plurality of leveling rolls disposed in a staggered state on upper and lower sides of a pass line of the metal sheet to be flattened and configured to rotate to sandwich and flatten the metal sheet while passing the metal sheet therethrough, a hydraulic pressing cylinder configured to press the metal sheet via the leveling rolls, and a drive unit configured to rotate the leveling rolls to pass the metal sheet, and a pinch roll unit disposed between the first leveling unit and the second leveling unit, and having a pair of pinch rolls configured to pinch the metal sheet and apply a drawing force thereto, the method including: setting the second leveling unit in a state where the metal sheet is to be not pressed or in a state where the metal sheet is to be pressed by the pressing cylinder with a pressing amount small enough to allow the metal sheet to be passed by the drive unit; then passing the metal sheet, toward the second leveling unit, through a first leveling roll array area of the first leveling unit, in which the leveling rolls are disposed, in a state where the metal sheet is not pressed or in a state where the metal sheet is pressed by the pressing cylinder with a pressing amount small enough to allow the metal sheet to be passed by the drive unit; then, when a leading end of the metal sheet reaches the pinch roll unit, increasing the pressing amount given by the pressing cylinder of the first leveling unit to a value necessary for flattening the metal sheet, and applying a drawing force by the pinch roll unit to the metal sheet to pass the metal sheet; then, when a tail end of the metal sheet reaches the pinch roll unit, setting the first leveling unit in a state where the metal sheet is to be not pressed or in a state where the metal sheet is to be pressed by the pressing cylinder with a pressing amount small enough to allow the metal sheet to be passed by the drive unit; and then increasing the pressing amount given by the pressing cylinder of the second leveling unit to a value necessary for flattening the metal sheet, and applying a drawing force by the pinch roll unit to the metal sheet to pass the metal sheet toward the first leveling unit.

According to a tenth aspect of the present invention, there is provided a metal sheet flattening method of flattening a metal sheet having a cut-sheet form in a roller leveler, which includes a plurality of leveling rolls disposed in a staggered state on upper and lower sides of a pass line of a metal sheet to be flattened and configured to rotate to sandwich and flatten the metal sheet while passing the metal sheet therethrough, a plurality of backup rolls that back up the plurality of leveling rolls on the upper and lower sides, a pair of roll frames that support the leveling rolls and the backup rolls on the upper and lower sides, respectively, a pair of frames that support the pair of roll frames on the upper and lower sides, respectively, a hydraulic pressing cylinder configured to press one of the pair of frames to press the metal sheet via one of the roll frames and the leveling rolls, a drive unit configured to rotate the leveling rolls, a plurality of hydraulic crowning cylinders arrayed along a width direction perpendicular to a pass direction of the metal sheet between one of the frames configured to be pressed by the pressing cylinder and a corresponding one of the roll frames, and a pinch roll unit disposed on one side of a leveling roll array area, in which the leveling rolls are disposed along the pass line of the metal sheet, and having a pair of pinch rolls configured to pinch the metal sheet and apply a drawing force thereto, the method including: causing the pressing cylinder to press the metal sheet via the leveling rolls with a pressing amount necessary for flattening the metal sheet, while passing the metal sheet between the leveling rolls by a driving force applied by the drive unit and the drawing force applied by the pinch rolls; and obtaining lateral deflection amounts of the pair of frames; calculating necessary tightening amounts of the respective hydraulic crowning cylinders necessary for compensating for the deflection amounts; and controlling tightening of the respective hydraulic crowning cylinders based on the necessary tightening amounts.

In the tenth aspect, it is preferable that the method include calculating necessary tightening amounts of the respective hydraulic crowning cylinders necessary for compensating for compressive deformation of the pressing cylinder, the hydraulic crowning cylinders, the pair of roll frames, the backup rolls, and the leveling rolls based on information on the compressive deformation; and controlling tightening of the respective hydraulic crowning cylinders based on a total value of the necessary tightening amounts necessary for compensating for the compressive deformation and the necessary tightening amounts necessary for compensating for the deflection amounts of the pair of frames.

In the present invention, it is preferable that the metal sheet to be flattened be a steel sheet having a thickness of 2.0 to 25.4 mm and a yield stress of 400 to 1,800 MPa.

EMBODIMENT FOR CARRYING OUT THE INVENTION

Embodiments of the present invention will now be described with reference to the accompanying drawings.

Figure 1:
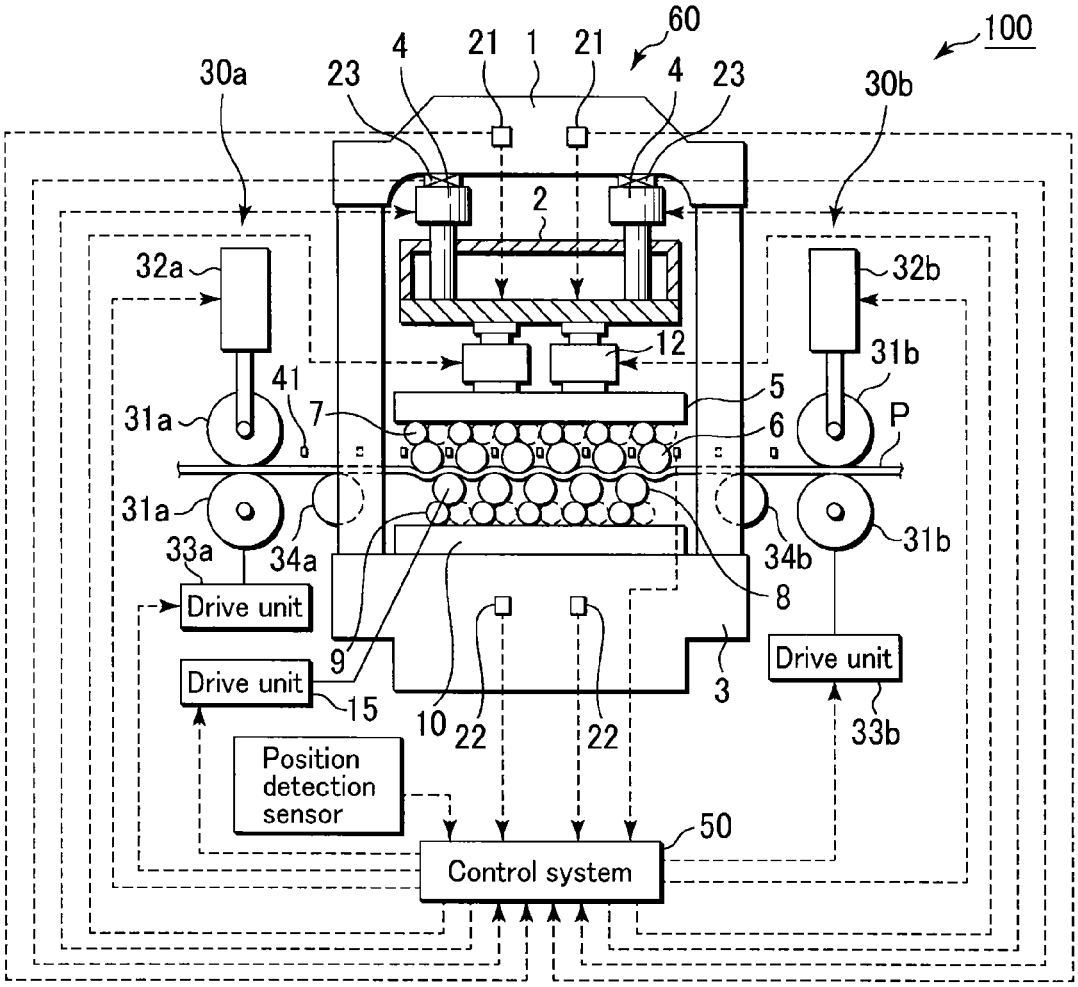
FIG. 1 is a side view showing a roller leveler according to an embodiment of the present invention.
Figure 2:
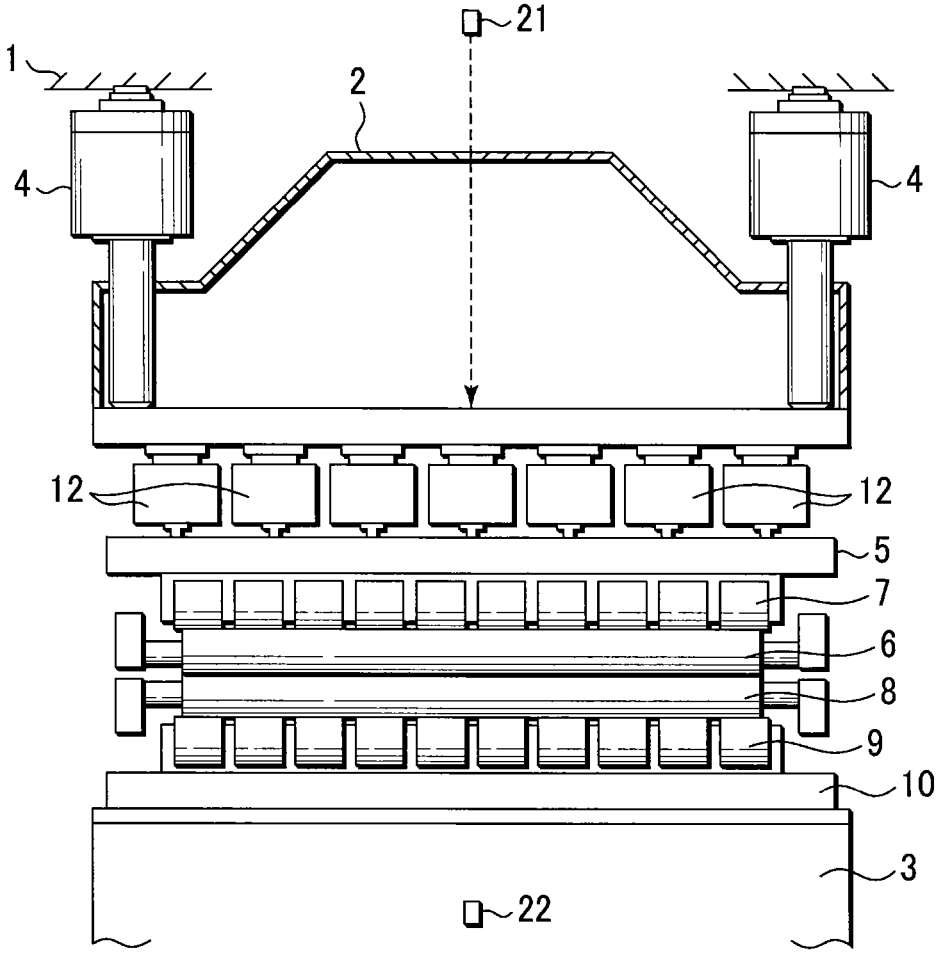
FIG. 2 is a front view showing the roller leveler according to the embodiment of the present invention.

FIG. 1 is a side view showing a roller leveler according to an embodiment of the present invention. FIG. 2 is a front view showing the roller leveler. The roller leveler 100 according to this embodiment is designed to flatten a metal sheet having a cut-sheet form, and includes a leveling unit 60, as shown in the drawings. The leveling unit includes a housing 1, an upper frame 2 disposed inside the housing 1, and a lower frame 3 disposed to support the housing 1. Hydraulic pressing cylinders (herein also referred to as "pushing cylinders") 4 are disposed between the housing 1 and the upper frame 2, and an upper roll frame 5 is disposed below the upper frame 2 and is hung by an upper roll grip cylinder (not shown). A plurality of upper leveling rolls 6 are disposed below the upper roll frame 5 of the leveling unit 60 and supported by the upper roll frame 5. A plurality of upper backup rolls 7 are disposed between the respective upper leveling rolls 6 and the upper roll frame 5 to back up the upper leveling rolls 6. The upper backup rolls 7 are each formed of a short body and supported by the upper roll frame 5 along the axial direction of the upper leveling rolls 6. Accordingly, the pressing cylinders 4 press down the upper roll frame 5, the upper backup rolls 7, and the upper leveling rolls 6.

In this specification, the term "press down" is intended to include not only a case where the pressure is applied downward as shown in FIG. 1 but also a case where the pressure is applied upward as explained later in a modification. In other words, the term "press down" can be replaced with the term "press" in this specification.

On the side opposite to the upper leveling rolls 6 with respect to the pass line of the metal sheet P, a plurality of lower leveling rolls 8 are disposed and supported by a lower roll frame 10 disposed therebelow. A plurality of lower backup rolls 9 are disposed between the respective leveling rolls 8 and the lower roll frame 10 to back up the lower leveling rolls 8. The lower backup rolls 9 are each formed of a short body and supported by the lower roll frame 10 along the axial direction of the lower leveling rolls 8. The lower roll frame 10 is disposed on the lower frame 3. In place of the pressing cylinders 4 for pressing the upper leveling rolls 6, pressing cylinders for pressing the lower leveling rolls 8 may be used.

The upper leveling rolls 6 and the lower leveling rolls 8 are respectively provided with drive units 15 (FIG. 1 shows only one unit for the sake of convenience) each including a rotary motor, so that the upper leveling rolls 6 and the lower leveling rolls 8 are rotated by the drive units 15. They are operated to flatten the metal sheet P by causing the pressing cylinders 4 to press the metal sheet P via the upper leveling rolls 6, while passing the metal sheet P between the upper leveling rolls 6 and the lower leveling rolls 8.

In the leveling unit 60, the upper frame 2 and the upper roll frame 5 are coupled with each other by a plurality of hydraulic crowning cylinders 12 disposed therebetween. As shown in FIG. 2, the respective crowning cylinders 12 are disposed at regular intervals to correspond to the leveling rolls 6 and 8 in the width direction perpendicular to the pass direction of the metal sheet P. As shown in FIG. 1, the hydraulic crowning cylinders 12 are arrayed in two rows. Although the crowning cylinders may be disposed in a row, the crowning cylinders disposed in two rows make it possible to more finely correct the local lateral deflection of the upper roll frame 5. The hydraulic crowning cylinders 12 are each equipped with a position detection sensor (not shown) built therein.

As shown in FIG. 2, deflection detection sensors 21 are disposed at positions central in the lateral direction above the upper frame 2 and configured to detect the lateral deflection of the upper frame 2. As shown in FIG. 1, the deflection detection sensors 21 are two sensors arranged along the pass line of the metal sheet P. The deflection detection sensors 21 continuously detect the distances to the lower side of the upper frame 2 to calculate the deflection amount of the upper frame 2 based on the distances. Further, deflection detection sensors 22 are disposed in internal space of the lower frame 3. The deflection detection sensors 22 are two sensors arranged, at positions central in the lateral direction, along the pass line of the metal sheet P. The deflection detection sensors 22 continuously detect the distances to the upper side of the lower frame 3 to calculate the deflection amount of the lower frame 3 based on the distances. The configuration described above may be modified such that only one of the upper frame 2 and the lower frame 3 is provided with deflection detection sensors and the deflection amount of the other frame is calculated using proportion.

Load cells (or hydraulic pressure converters) 23 are attached between the pressing cylinders 4 and the housing 1, and used to detect compressive deformation of the pressing cylinders 4, hydraulic crowning cylinders 12, upper roll frame 5, upper backup rolls 7, upper leveling rolls 6, lower leveling rolls 8, lower backup rolls 9, and lower roll frame 10.

A first pinch roll unit 30*a* including a pair of pinch rolls 31*a* and a second pinch roll unit 30*b* including a pair of pinch rolls 31*b* are respectively disposed on the opposite outsides of the area, in which the leveling rolls are disposed, or the leveling roll array area, along the pass line of the metal sheet P to pinch and draw the metal sheet P. The clearance between the pair of pinch rolls 31*a* is adjusted by a pinch roll cylinder 32*a*, and the clearance between the pair of pinch rolls 31*b* is adjusted by a pinch roll cylinder 32*b*. The pinch rolls 31*a* and the pinch rolls 31*b* are configured to be rotated respectively by drive units 33*a* and 33*b* each including a rotary motor to provide a drawing force to draw the metal sheet P, the material to be flattened. Further, guide rolls 34*a* and 34*b* are respectively disposed between the pair of pinch rolls 31*a* and the leveling roll array area and between the pair of pinch rolls 31*b* and the leveling roll array area.

A plurality of optical sensors 41 are disposed along the pass line between the pinch rolls 31*a* and 31*b* and they serve as a position detection mechanism to detect the position of the leading end of the metal sheet P. The optical sensors 41 are used to detect the leading end, and then a pulse generator (not shown) is used to perform tracking on the leading end of the metal sheet P.

The roller leveler 100 according to this embodiment is designed such that a control system 50 controls its respective components. The control system 50 includes a process controller having a CPU, a user interface connected to the process controller and having a keyboard and a display, and a storage section that stores recipes containing control programs (software) and process condition data recorded therein. A required recipe is retrieved from the storage section and executed by the process controller in accordance with an instruction or the like input through the user interface. Consequently, the roller leveler 100 can perform a predetermined process (operational sequence) as described later under the control of the process controller. The recipes containing control programs and process condition data that are stored in a computer readable storage medium, such as a magnetic disk (flexible disk, hard disk, etc.), an optical disk (CD, DVD, etc.), a magneto-optical disk (MO, etc.), and/or a semiconductor memory, may be used. Alternatively, the recipes may be available online, that is, may be transmitted from another apparatus through, e.g., a dedicated line, as needed.

In order to flatten the metal sheet P (i.e., to perform leveling), the control system 50 controls the penetration depth (pressing amount) of the leveling rolls 6 and 8 given by the pressing cylinders 4, controls the press timing and penetration depth (pressing amount) of the pinch roll cylinder 32*a* or 32*b*, and controls the drive units 15, 33*a*, and 33*b*, based on positional information on the metal sheet P obtained by the optical sensors 41. Further, the control system 50 receives information on the deflection of the upper frame 2 and the lower frame 3 sent thereto from the deflection detection sensors 21 and 22, or it receives, in addition to this information, information on the compressive deformation of the pressing cylinders 4, hydraulic crowning cylinders 12, upper roll frame 5, upper backup rolls 7, upper leveling rolls 6, lower leveling rolls 8, lower backup rolls 9, and lower roll frame 10 sent thereto. Then, the control system 50 uses its calculating function to calculate necessary tightening amounts of the respective hydraulic crowning cylinders 12 based on the pieces of information mentioned above, so that it controls the tightening by the respective hydraulic crowning cylinders 12 based on positional information obtained by the position detection sensors in the respective hydraulic crowning cylinders 12.

Next, an explanation will be given of an operation of the roller leveler 100 thus structured, in flattening a metal sheet P having a cut-sheet form.

When the leveling rolls 6 and 8 are used to reduce the internal stress of the metal sheet P by their driving force and flatten the metal sheet P, it is necessary to satisfy the following formula (1), where, in association with the metal sheet P, "t" (mm) is sheet thickness, E ($N/mm^2$) is Young's modulus, δy ($N/mm^2$) is yield stress, D (mm) is roll diameter, and η is yield ratio.

$$1-\eta=(\delta y\cdot D)/(E\cdot t) \quad (1)$$

In this formula, the yield ratio is required to be 0.7 or more to sufficiently reduce the internal stress. Accordingly, it is necessary to satisfy the following formula (2).

$$0.3\geq(\delta y\cdot D)/(E\cdot t) \quad (2)$$

This formula can be transformed into the following formula (3).

$$D\leq 0.3\cdot(E\cdot t)/\delta y \quad (3)$$

Accordingly, it is necessary that the smaller the sheet thickness "t" is or the larger the yield stress δy is, the smaller the diameter of the leveling rolls is set. However, the smaller the diameter of the leveling rolls is, the smaller the torque of the leveling rolls becomes.

Accordingly, when the leveling rolls are used to flatten a metal sheet having a small thickness and a large yield stress and are given a penetration depth (pressing amount) to obtain a yield ratio necessary for flattening the metal sheet, the material to be flattened, it may become difficult to pass the metal sheet because of an insufficient torque of the leveling rolls.

According to this embodiment made in light of this problem, the pinch rolls 31*a* or 31*b* are used to apply a drawing force to the metal sheet P to assist the driving force of the leveling rolls. Consequently, it is possible to pass the metal sheet while applying the pressing amount necessary for the flattening, even when the metal sheet has a small thickness and a large yield stress.

Figure 3:
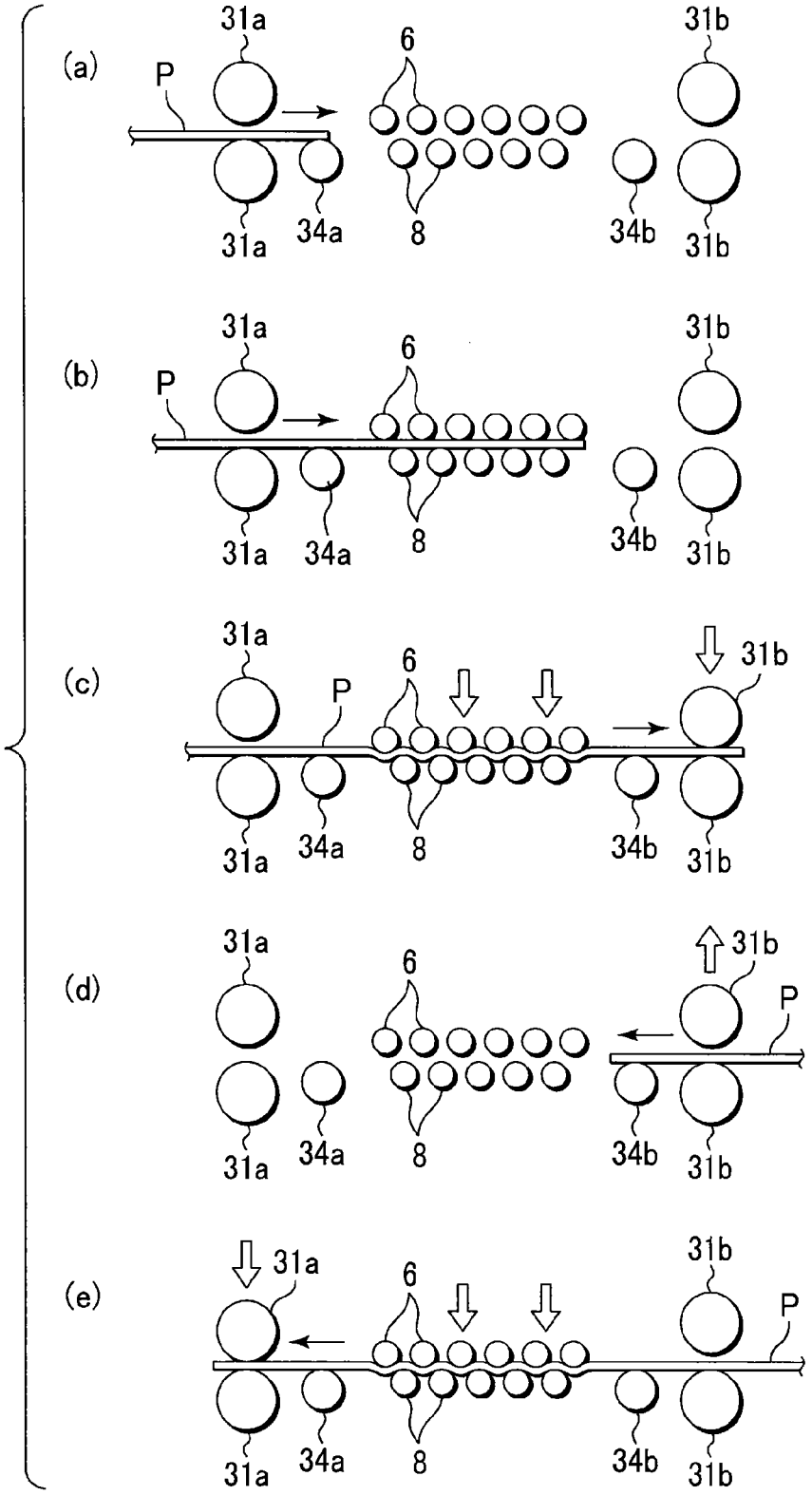
FIG. 3 is a diagram for explaining an operation of flattening a metal sheet performed in the roller leveler according to the embodiment of the present invention.

Specifically, the sheet passing is performed as shown in FIG. 3. The following operation is conducted under the control of the control system 50.

At first, as shown in FIG. 3, (a), the metal sheet P is fed from the pinch rolls 31*a*-side toward the leveling roll array area. Then, when the metal sheet P reaches the leveling roll array area, the metal sheet P is sandwiched between the upper leveling rolls 6 and the lower leveling rolls 8 and is passed by the drive unit 15, as shown in FIG. 3, (b). At this time, the metal sheet P is passed in a state where it is not pressed by the pressing cylinders 4 or in a state where it is pressed by the pressing cylinders 4 with a penetration depth (pressing amount) small enough to allow the metal sheet P to be passed by the drive unit 15. Then, as shown in FIG. 3, (c), when optical sensors 41 serving as the position detection mechanism detect that the leading end of the metal sheet P reaches the pinch rolls 31*b*, the pressing amount of the upper leveling rolls 6 is increased to a value necessary for flattening the metal sheet P, and the pinch roll cylinder 32*b* is driven to pinch the metal sheet P by the pair of pinch rolls 31*b* and draw the metal sheet P by the driving force of the drive unit 33*b*. In other words, the drawing force of the pinch rolls 31*b* is used to compensate for the shortfall in the driving force of the leveling rolls when the metal sheet P is flattened. Consequently, it is possible to pass the metal sheet while applying the penetration depth necessary for the flattening, even when the metal sheet has a small thickness and a large yield stress.

While the flattening described above is performed to the tail end of the metal sheet P, such a part of the metal sheet P which passes through the leveling roll array area at the beginning is not sufficiently flattened because it is given only a penetration depth (pressing amount) small enough to allow the metal sheet P to be passed by the driving force of the leveling rolls alone. Accordingly, when the optical sensors 41 serving as the position detection mechanism and a pulse generator (not shown) detect that the tail end of the metal sheet P has passed through the leveling roll array area, the pressing by the pinch roll cylinder 32*b* is dismissed to stop the drawing by the pinch rolls 31*b*, and the rotational direction of the leveling rolls is reversed to feed the metal sheet P toward the pinch rolls 31*a*, as shown in FIG. 3, (d). At this time, the penetration depth of the upper leveling rolls 6 is set at a value small enough to allow the metal sheet P to be passed. Then, as shown in FIG. 3, (e), when the optical sensors 41 serving as the position detection mechanism detect that the tail end of the metal sheet P reaches the pinch rolls 31*a*, the penetration depth of the upper leveling rolls 6 is increased to a value necessary for flattening the metal sheet P, and the pinch roll cylinder 32*b* is driven to pinch the metal sheet P by the pair of pinch rolls 31*b* and draw the metal sheet P by the driving force of the drive unit 33*b*. Consequently, it is possible to pass the metal sheet while applying the penetration depth (pressing amount) necessary for the flattening, as described above, so as to sufficiently flatten the first part of the metal sheet P that has not been sufficiently flattened.

As described above, the metal sheet P is entirely flattened when the metal sheet P is passed back and forth once. Consequently, even when the metal sheet has a small thickness and a large yield stress, it is possible to flatten the metal sheet with a high degree of accuracy to improve the flatness of the metal sheet P. However, in order to utilize this technique, the metal sheet P needs to have a length with which the necessary flattening is performed entirely over the metal sheet P by moving the metal sheet P back and forth once in the roller leveler 100. In this respect, if the metal sheet P is too short, the flattening operation in one direction is made such that flattening with the drawing by the pinch rolls becomes less than half of the metal sheet P, so the necessary flattening cannot be performed entirely over the metal sheet P by the flattening operation in the opposite direction. It is preferable for the metal sheet P having a cut-sheet form to have a length of 5 m or more. The number of back and forth motions of the metal sheet P is not limited to one, but may be two or more.

When the metal sheet used is a steel sheet, the technique described above can be suitably used to process the steel sheet having a thickness of 2.0 to 25.4 mm and a yield stress of 400 to 1,800 MPa, which has been difficult to flatten.

Figure 4:
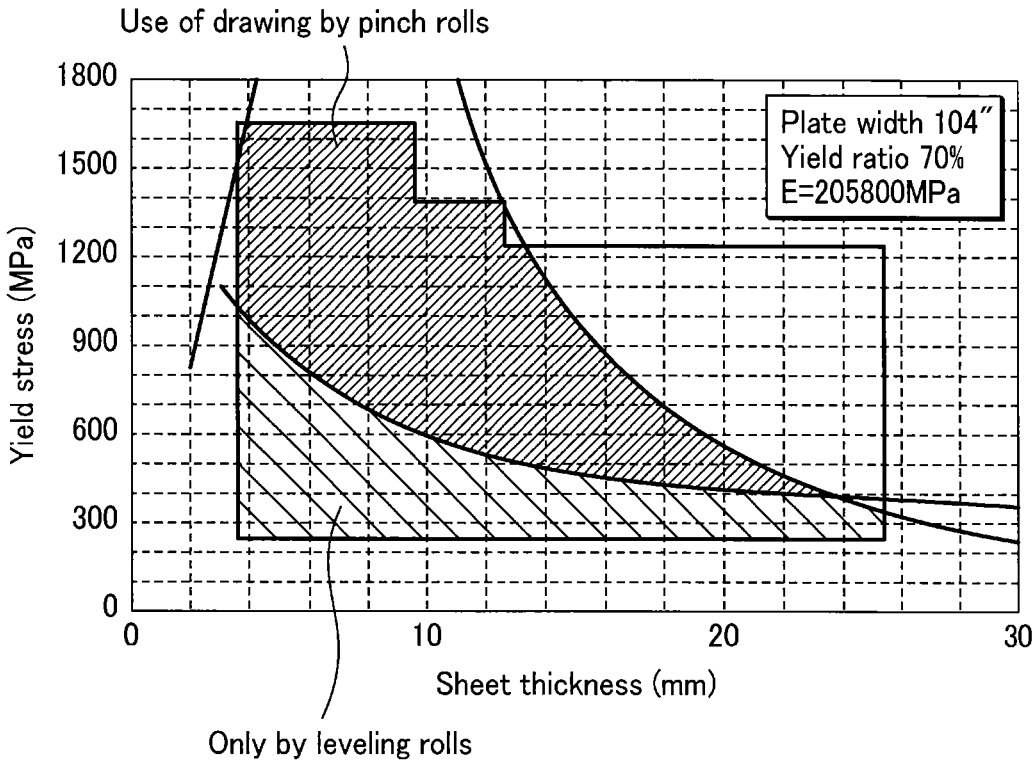
FIG. 4 is a diagram, where the abscissa axis denotes sheet thickness and the ordinate axis denotes yield stress, showing a flattenable region, in which flattening can be performed at a yield ratio of 70% (0.7), respectively obtained in the case of the leveling rolls being used alone and in the case of the leveling rolls being used along with a drawing operation by pinch rolls.

FIG. 4 is a diagram, where the abscissa axis denotes sheet thickness and the ordinate axis denotes yield stress, showing the region (flattenable region), in which flattening can be performed at a yield ratio of 70% (0.7), respectively obtained in the case of the leveling rolls being used alone and in the case of the leveling rolls being used along with a drawing operation by the pinch rolls according to this embodiment. As shown in FIG. 4, use of the drawing by the pinch rolls provides a remarkably expanded flattenable region, so that it is possible to flatten a material having a relatively small thickness of 12.7 mm or less and a large yield stress of 1,200 MPa or more, to obtain a metal sheet with high flatness. The relationship shown in FIG. 4 is obtained when the leveling rolls having a diameter of 135 mm are used to perform flattening.

As described above, by utilizing the drawing force exerted by the pinch rolls, it is possible to flatten the metal sheet, the material to be flattened, with the required penetration depth (pressing amount) to attain high flatness. In this case, however, some of the components of the machine, such as the upper frame 2 and the lower frame 3, may be deflected in the width direction and, when this occurs, the penetration depth to the metal sheet varies in the width direction because of the deflection. Accordingly, in this embodiment, when it is desired to eliminate the influence of the deflection, detection values obtained by the deflection detection sensors 21 and/or 22 are used to derive the deflection amounts of the upper frame 2 and the lower frame 3. Then, the necessary tightening amounts of the respective hydraulic crowning cylinders 12 are calculated to compensate for the deflection amounts, and are used to perform a crowning correction on the upper leveling rolls 6. Consequently, it is possible to reduce the difference in the penetration depth in the width direction of the metal sheet P, the material to be flattened, which makes it possible to perform the flattening with higher flatness.

In addition to the necessary tightening amounts of the respective hydraulic crowning cylinders 12 necessary for compensating for the deflection amounts of the upper frame 2 and the lower frame 3, the necessary tightening amounts of the respective hydraulic crowning cylinders 12 for compensating for the compressive deformation may be calculated based on the information on compressive deformation obtained via the load cells (or hydraulic pressure converters) 23 attached between the pressing cylinders 4 and the housing 1, that is, the information on compressive deformation of the pressing cylinders 4, hydraulic crowning cylinders 12, upper roll frame 5, upper backup rolls 7, upper leveling rolls 6, lower leveling rolls 8, lower backup rolls 9, and lower roll frame 10, and the total value of the two sets of the necessary tightening amounts may be used to perform a crowning correction on the upper leveling rolls 6. This makes it possible to further reduce the difference in the penetration depth in the width direction of the metal sheet P, the material to be flattened, making it possible to perform the flattening with much higher flatness.

Japanese Patents No. 3443036 and No. 3726146 disclose crowning correction of this type in detail, the entire contents of which are incorporated by reference herein.

Next, an explanation will be given of another embodiment of the present invention.

Figure 5:
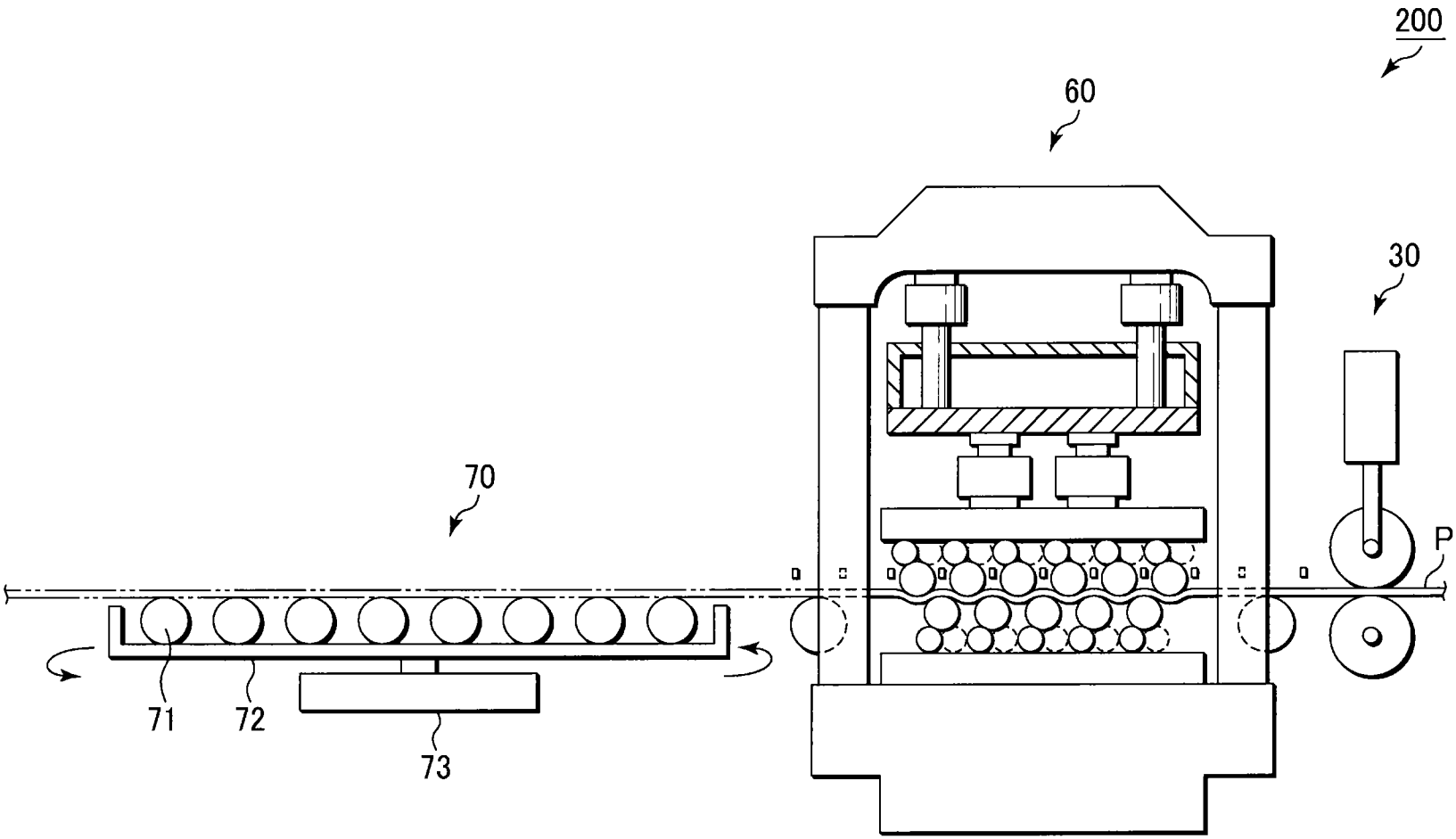
FIG. 5 is a side view showing a roller leveler according to another embodiment of the present invention.

FIG. 5 is a sectional view schematically showing a facility structure of a roller leveler according to another embodiment of the present invention. In FIG. 5, the control system 50 and so forth are not shown.

This roller leveler 200 includes: a leveling unit 60 having a structure the same as that of the former embodiment; a single pinch roll unit 30 disposed on one outside of the leveling roll array area along the pass line of the metal sheet and having a structure the same as that of the pinch roll units 30*a* and 30*b* of the former embodiment; and a metal sheet reversing mechanism 70 disposed on the other outside of the leveling roll array area of the leveling unit 60 and configured to turn the metal sheet P to reverse positions of its leading end and tail end.

The metal sheet reversing mechanism 70 includes a plurality of transfer rolls 71 for transferring the metal sheet P and a support frame 72 that supports the transfer rolls 71. The metal sheet reversing mechanism 70 further includes a rotating mechanism 73 configured to rotate the metal sheet present on the transfer rolls 71, along with the transfer rolls 71 and the support frame 72, so as to turn the metal sheet P to reverse positions of its leading end and tail end.

The leveling unit 60 and the pinch roll unit 30 are the same in structure as the leveling unit and the pinch roll unit of the former embodiment, so the reference symbols thereon are omitted.

Next, with reference to FIG. 6, a flattening operation of this roller leveler 200 will be explained.

Figure 6:
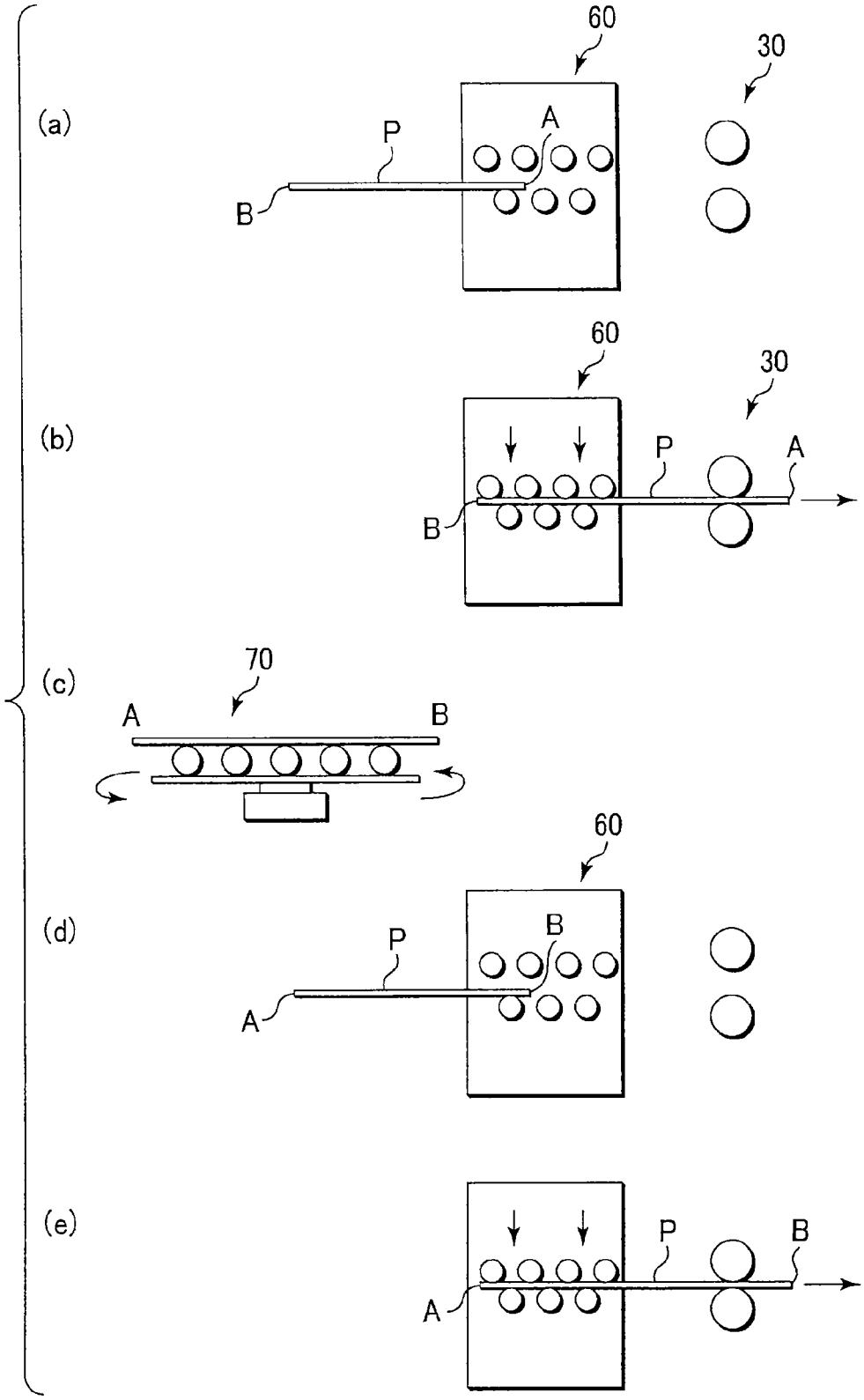
FIG. 6 is a diagram for explaining an operation of flattening a metal sheet performed in the roller leveler according to another embodiment of the present invention.

At first, the metal sheet P is fed from that side of the leveling unit 60 adjacent to the metal sheet reversing mechanism 70 into the leveling roll array area toward the pinch roll unit 30 (FIG. 6, (a)). Then, the metal sheet P is passed in a state where it is not pressed or in a state where it is pressed by the pressing cylinders with a penetration depth small enough to allow the metal sheet P to be passed by the drive unit. When the leading end A of the metal sheet P reaches the pinch roll unit 30, the penetration depth given by the pressing cylinders is increased to a value necessary for flattening the metal sheet, and a drawing force is applied by the pinch roll unit 30 to the metal sheet P to pass it through (FIG. 6, (b)). When the tail end B of the metal sheet P has passed through the leveling roll array area, the metal sheet P is transferred into the metal sheet reversing mechanism 70 and the metal sheet P is turned to reverse positions of its leading end A and tail end B (FIG. 6, (c)). Then, the metal sheet P thus reversed is passed from that side of the leveling unit 60 adjacent to the metal sheet reversing mechanism 70 through the leveling roll array area in a state where it is not pressed or in a state where it is pressed by the pressing cylinders with a penetration depth small enough to allow the metal sheet P to be passed by the drive unit (FIG. 6, (d)). When the leading end of the metal sheet P (the former tail end B) reaches the pinch roll unit, the penetration depth given by the pressing cylinders is increased to a value necessary for flattening the metal sheet, and a drawing force is applied by the pinch roll unit 30 to the metal sheet P to pass it through (FIG. 6, (e)). As described above, even when the first part of the metal sheet P has been insufficiently flattened by the first one passage, this part is then sufficiently flattened by reversing the metal sheet P and making another passage.

Next, an explanation will be given of still another embodiment of the present invention.

Figure 7:
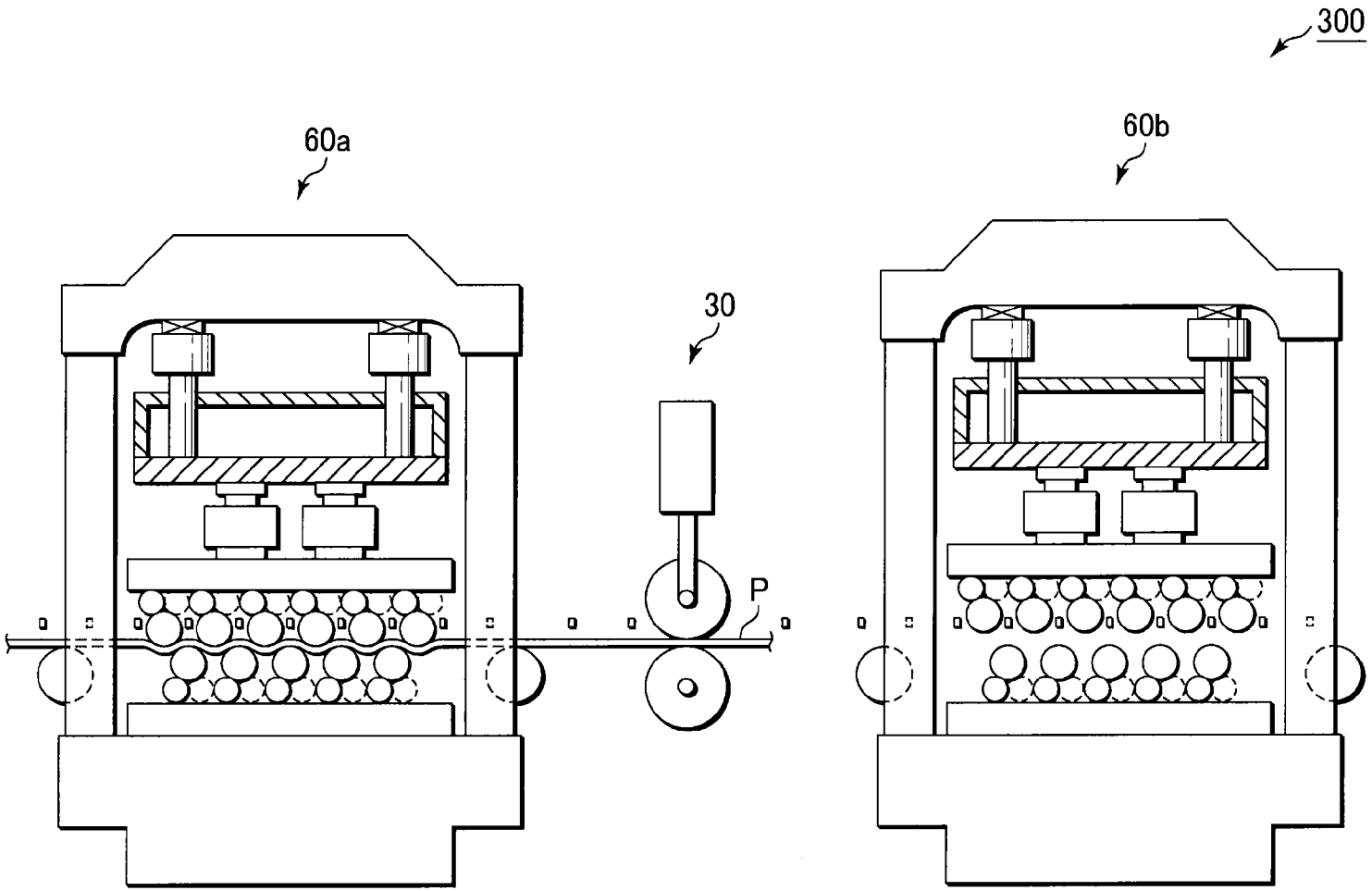
FIG. 7 is a side view showing a roller leveler according to still another embodiment of the present invention.

FIG. 7 is a sectional view schematically showing a facility structure of a roller leveler according to still another embodiment of the present invention. In FIG. 7, the control system 50 and so forth are not shown.

This roller leveler 300 includes a leveling unit 60*a* and a leveling unit 60*b* arrayed along the pass direction of the metal sheet P, each of which has the same structure as that of the former embodiment. A single pinch roll unit 30 is disposed between the leveling units 60*a* and 60*b* and has the same structure as that of the pinch roll units 30*a* and 30*b* of the former embodiment.

The leveling units 60*a* and 60*b* and the pinch roll unit 30 are the same in structure as the leveling unit and the pinch roll unit of the former embodiment, so the reference symbols thereon are omitted.

Figure 8:
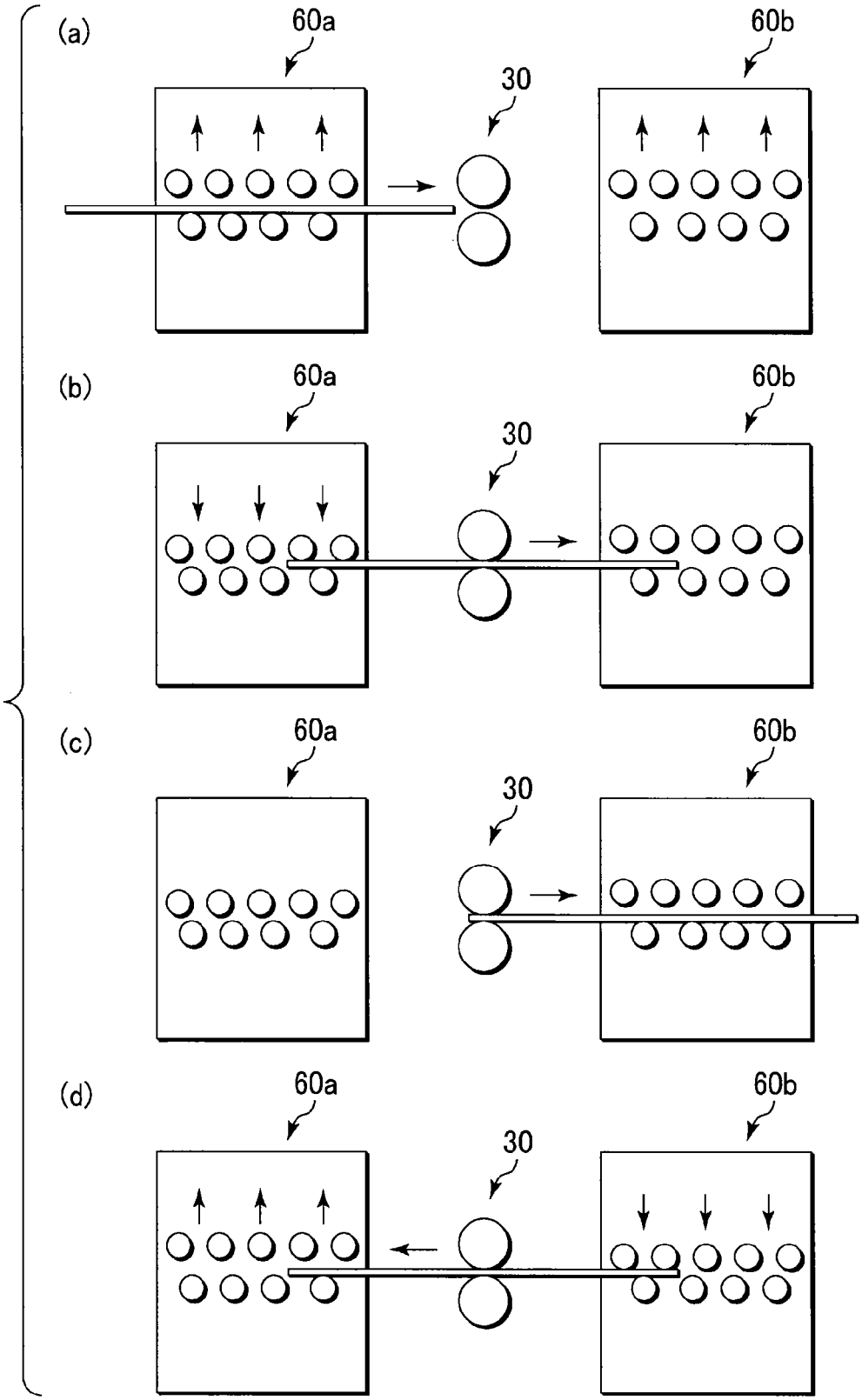
FIG. 8 is a diagram for explaining an operation of flattening a metal sheet performed in the roller leveler according to still another embodiment of the present invention.

Next, with reference to FIG. 8, a flattening operation of this roller leveler 300 will be explained.

At first, the second leveling unit is set in a state where the metal sheet is to be not pressed or in a state where it is to be pressed by the pressing cylinders with a penetration depth small enough to allow the metal sheet to be passed by the drive unit. In this state, the metal sheet is passed, toward the second leveling unit, through the first leveling roll array area, in which the leveling rolls of the first leveling unit are disposed, in a state where it is not pressed or in a state where it is pressed by the pressing cylinders with a penetration depth small enough to allow the metal sheet to be passed by the drive unit (FIG. 8, (a)). When the leading end of the metal sheet P reaches the pinch roll unit 30, the penetration depth given by the pressing cylinders of the first leveling unit 60*a* is increased to a value necessary for flattening the metal sheet, and a drawing force is applied by the pinch roll unit 30 to the metal sheet P to pass it through (FIG. 8, (b)). When the tail end of the metal sheet P reaches the pinch roll unit 30 (FIG. 8, (c)), the first leveling unit 60*a* is set in a state where the metal sheet P is to be not pressed or in a state where it is to be pressed by the pressing cylinders with a penetration depth small enough to allow the metal sheet P to be passed by the drive unit. Further, the penetration depth given by the pressing cylinders of the second leveling unit 60*b* is increased to a value necessary for flattening the metal sheet P, and a drawing force is applied by the pinch roll unit 30 to the metal sheet to pass it through toward the first leveling unit 60*a* (FIG. 8, (d)). As described above, even when the first part of the metal sheet P has been insufficiently flattened by the passage through the first leveling unit 60*a*, this part is then sufficiently flattened by the passage through the second leveling unit 60*b*.

According to the embodiments of the present invention, the drawing force by the pinch rolls is added to the driving force of the leveling rolls to pass the metal sheet between the leveling rolls, so that the metal sheet is passed even when the torque of the leveling rolls is insufficient to pass the metal sheet for flattening. Consequently, even when the metal sheet has a small thickness and a large yield stress, it is possible to pass the metal sheet while applying a penetration depth necessary for the flattening, thereby improving the flatness of the metal sheet. Further, in addition to this, the crowning correction in the width direction may be performed to further improve the flatness of the metal sheet.

The present invention is not limited to the embodiments described above, and it may be modified in various manners. For example, in the embodiments described above, the machine has a structure designed to press (press downward) the upper rolls of the leveling rolls toward the lower rolls, but it may be modified to press (press upward) the lower rolls toward the upper rolls. Further, the present invention should be construed to encompass arrangements obtained by omitting some of the components of the embodiments described above, as long as they do not depart from the scope of the present invention.

The invention claimed is:

1. A metal sheet flattening method of flattening a metal sheet having a cut-sheet form in a roller leveler, which includes a plurality of leveling rolls disposed in a staggered state on upper and lower sides of a pass line of the metal sheet to be flattened and configured to rotate to sandwich and flatten the metal sheet while passing the metal sheet therethrough, a hydraulic pressing cylinder configured to press the metal sheet via the leveling rolls, a drive unit configured to rotate the leveling rolls to pass the metal sheet, and a pinch roll unit disposed on one side of a leveling roll array area, in which the leveling rolls are disposed along the pass line of the metal sheet, and including a pair of pinch rolls configured so that a clearance between the pair of pinch rolls is adjusted by a pinch roll cylinder, and configured to pinch the metal sheet using a pinch roll cylinder and apply a drawing force by the application of a pinch roll drive unit thereto, the method comprising, in the following order:

passing the metal sheet that is a steel sheet having a thickness of 2.0 to 25.4 mm and a yield stress of 400 to 1,800 MPa through the leveling roll array area in a state where the steel sheet is not pressed or in a state where the steel sheet is pressed by the pressing cylinder of the leveling rolls with a pressing amount small enough to allow the steel sheet to be passed by the drive unit of the leveling rolls;

when a leading end of the steel sheet reaches the pinch roll unit, increasing the pressing amount given by the pressing cylinder of the leveling rolls to a value necessary for flattening the steel sheet and driving the pinch roll cylinder to pinch the steel sheet by the pair of pinch rolls; and passing the steel sheet between the leveling rolls by a driving force applied by the drive unit of the leveling rolls and the drawing force applied by the pinch rolls using the pinch roll drive unit;

wherein the pinch rolls and the leveling rolls apply respective drawing forces which pull the steel sheet in the same direction through the leveling rolls.

2. The metal sheet flattening method according to claim 1, which further includes a pair of roll frames that support the leveling rolls on the upper and lower sides, respectively, a pair of frames that support the pair of roll frames on the upper and lower sides, respectively, wherein one of the pair of frames is configured to be pressed by the pressing cylinder from a side opposite to the leveling rolls, and a plurality of hydraulic crowning cylinders arrayed along a width direction perpendicular to a pass direction of the steel sheet between one of the frames configured to be pressed by the pressing cylinder and a corresponding one of the roll frames, the method further comprising:

obtaining lateral deflection amounts of the pair of frames;

calculating necessary tightening amounts of the respective hydraulic crowning cylinders necessary for compensating for the deflection amounts; and controlling tightening of the respective hydraulic crowning cylinders based on the necessary tightening amounts.

3. The metal sheet flattening method according to claim 2, wherein the method comprises:

calculating necessary tightening amounts of the respective hydraulic crowning cylinders necessary for compensating for compressive deformation of the pressing cylinder, the hydraulic crowning cylinders, the pair of roll frames, and the leveling rolls based on information on the compressive deformation; and controlling tightening of the respective hydraulic crowning cylinders based on a total value of the necessary tightening amounts necessary for compensating for the compressive deformation and the necessary tightening amounts necessary for compensating for the deflection amounts of the pair of frames.

4. The metal sheet flattening method according to claim 1, wherein the roller leveler further includes a plurality of backup rolls that back up the plurality of leveling rolls on the upper and lower sides.

5. A metal sheet flattening method of flattening a metal sheet having a cut-sheet form in a roller leveler, which includes a leveling unit that has a plurality of leveling rolls disposed in a staggered state on upper and lower sides of a pass line of the metal sheet to be flattened and configured to rotate to sandwich and flatten the metal sheet while passing the metal sheet therethrough, a hydraulic pressing cylinder configured to press the metal sheet via the leveling rolls, and a drive unit configured to rotate the leveling rolls to pass the metal sheet, and a first pinch roll unit and a second pinch roll unit respectively disposed on opposite outsides of a leveling roll array area, in which the leveling rolls are disposed along the pass line of the metal sheet, each of the first and second pinch roll units including a pair of pinch rolls configured so that a clearance between each pair of pinch rolls is adjusted by a pinch roll cylinder, and configured to pinch the metal sheet using the pinch roll cylinders and apply a drawing force by the application of pinch roll drive units thereto, the method comprising, in the following order:

passing the metal sheet that is a steel sheet having a thickness of 2.0 to 25.4 mm and a yield stress of 400 to 1,800 MPa through the leveling roll array area in a first direction oriented from the first pinch roll unit toward the second pinch roll unit, in a state where the steel sheet is not pressed or in a state where the steel sheet is pressed by the pressing cylinder with a pressing amount small enough to allow the steel sheet to be passed by the drive unit of the leveling rolls;

when a leading end of the steel sheet reaches the second pinch roll unit, increasing the pressing amount given by the pressing cylinder of the leveling rolls to a value necessary for flattening the steel sheet and driving the pinch roll cylinder of the second pinch roll unit to pinch the steel sheet by the pair of pinch rolls of the second pinch roll unit, and applying a drawing force in the first direction by the second pinch roll unit to the steel sheet to pass the steel sheet using the pinch roll drive unit of the second pinch roll unit;

when a tail end of the steel sheet has passed through the leveling roll array area, changing a feed direction of the steel sheet from the first direction to a second direction opposite to the first direction;

passing the steel sheet through the leveling roll array area in the second direction, in a state where the steel sheet is not pressed or in a state where the steel sheet is pressed by the pressing cylinder of the leveling rolls with a pressing amount small enough to allow the steel sheet to be passed by the drive unit of the leveling rolls; and when the tail end of the steel sheet reaches the first pinch roll unit, increasing the pressing amount given by the pressing cylinder of the leveling rolls to a value necessary for flattening the steel sheet and driving the pinch roll cylinder of the first pinch roll unit to pinch the steel sheet by the pair of pinch rolls of the first pinch roll unit, and applying a drawing force in the second direction by the first pinch roll unit to the steel sheet to pass the steel sheet using the pinch roll drive unit of the first pinch roll unit, wherein the pinch rolls and the leveling rolls apply respective drawing forces which pull the steel sheet in the same direction through the leveling rolls.

6. A metal sheet flattening method of flattening a metal sheet having a cut-sheet form in a roller leveler, which includes a leveling unit that has a plurality of leveling rolls disposed in a staggered state on upper and lower sides of a pass line of the metal sheet to be flattened and configured to rotate to sandwich and flatten the metal sheet while passing the metal sheet therethrough, a hydraulic pressing cylinder configured to press the metal sheet via the leveling rolls, and a drive unit configured to rotate the leveling rolls to pass the metal sheet, a pinch roll unit disposed on one outside of a leveling roll array area, in which the leveling rolls are disposed along the pass line of the metal sheet, and including a pair of pinch rolls configured so that a clearance between the pair of pinch rolls is adjusted by a pinch roll cylinder, and configured to pinch the metal sheet using the pinch roll cylinder and apply a drawing force by the application of a pinch roll drive unit thereto, and a metal sheet reversing mechanism disposed on the other outside of the leveling roll array area, and configured to turn the metal sheet to reverse positions of leading and tail ends thereof, the method comprising, in the following order:

passing the metal sheet that is a steel sheet having a thickness of 2.0 to 25.4 mm and a yield stress of 400 to 1,800 MPa through the leveling roll array area from a metal sheet reversing mechanism-side of the leveling unit, in a state where the steel sheet is not pressed or in a state where the steel sheet is pressed by the pressing cylinder of the leveling rolls with a pressing amount small enough to allow the steel sheet to be passed by the drive unit of the leveling rolls; when a leading end of the steel sheet reaches the pinch roll unit, increasing the pressing amount given by the pressing cylinder of the leveling rolls to a value necessary for flattening the steel sheet and driving the pinch roll cylinder to pinch the steel sheet by the pair of pinch rolls, and applying a drawing force by the pinch roll unit to the steel sheet using the pinch roll drive unit to pass the steel sheet;

when a tail end of the steel sheet has passed through the leveling roll array area, transferring the steel sheet into the metal sheet reversing mechanism and turning the steel sheet to reverse positions of the leading end and the tail end thereof;

passing the steel sheet thus reversed through the leveling roll array area from the metal sheet reversing mechanism-side, in a state where the steel sheet is not pressed or in a state where the steel sheet is pressed by the pressing cylinder of the leveling rolls with a pressing amount small enough to allow the steel sheet to be passed by the drive unit of the leveling rolls; and when the leading end of the steel sheet reaches the pinch roll unit, increasing the pressing amount given by the pressing cylinder of the leveling rolls to a value necessary for flattening the steel sheet and driving the pinch roll cylinder to pinch the steel sheet by the pair of pinch rolls, and applying a drawing force by the pinch roll unit to the steel sheet using the pinch roll drive unit to pass the steel sheet, wherein the pinch rolls and the leveling rolls apply respective drawing forces which pull the steel sheet in the same direction through the leveling rolls.

7. A metal sheet flattening method of flattening a metal sheet having a cut-sheet form in a roller leveler, which includes first and second leveling units arrayed along a pass direction of the metal sheet, and each having a plurality of leveling rolls disposed in a staggered state on upper and lower sides of a pass line of the metal sheet to be flattened and configured to rotate to sandwich and flatten the metal sheet while passing the metal sheet therethrough, a hydraulic pressing cylinder configured to press the metal sheet via the leveling rolls, and a drive unit configured to rotate the leveling rolls to pass the metal sheet, and a pinch roll unit disposed between the first leveling unit and the second leveling unit, and having a pair of pinch rolls configured to pinch the metal sheet and apply a drawing force thereto, the method comprising, in the following order:

setting the second leveling unit in a state where the metal sheet is to be not pressed or in a state where the metal sheet is to be pressed by the pressing cylinder with a pressing amount small enough to allow the metal sheet to be passed by the drive unit;

then passing the metal sheet, toward the second leveling unit, through a first leveling roll array area of the first leveling unit, in which the leveling rolls are disposed, in a state where the metal sheet is not pressed or in a state where the metal sheet is pressed by the pressing cylinder with a pressing amount small enough to allow the metal sheet to be passed by the drive unit;

then, when a leading end of the metal sheet reaches the pinch roll unit, increasing the pressing amount given by the pressing cylinder of the first leveling unit to a value necessary for flattening the metal sheet, and applying a drawing force by the pinch roll unit to the metal sheet to pass the metal sheet;

then, when a tail end of the metal sheet reaches the pinch roll unit, setting the first leveling unit in a state where the metal sheet is to be not pressed or in a state where the metal sheet is to be pressed by the pressing cylinder with a pressing amount small enough to allow the metal sheet to be passed by the drive unit; and then increasing the pressing amount given by the pressing cylinder of the second leveling unit to a value necessary for flattening the metal sheet, and applying a drawing force by the pinch roll unit to the metal sheet to pass the metal sheet toward the first leveling unit.

* * * * *